US006588136B2

(12) United States Patent
Baker et al.

(10) Patent No.: US 6,588,136 B2
(45) Date of Patent: Jul. 8, 2003

(54) DECOCKING LEVER

(76) Inventors: Richard L Baker, 2701 W. Waters Ave., Apt. 1409, Tampa, FL (US) 33614; Eric T Myers, 7 Sandy Glen Ct., Columbia, SC (US) 29223

( * ) Notice: Subject to any disclaimer, the term of this patent is extended or adjusted under 35 U.S.C. 154(b) by 0 days.

(21) Appl. No.: 09/975,526

(22) Filed: Oct. 11, 2001

(65) Prior Publication Data

US 2003/0070342 A1 Apr. 17, 2003

(51) Int. Cl.[7] ..... F41A 17/74

(52) U.S. Cl. ..... 42/70.05; 42/70.02; 42/70.08; 89/144; 89/146; 89/147

(58) Field of Search ..... 42/69.03, 70.02, 42/70.05, 70.08; 89/142, 144, 147, 148

(56) References Cited

U.S. PATENT DOCUMENTS

| | | | | | |
|---|---|---|---|---|---|
| 2,875,545 | A | | 3/1959 | Westmoreland | |
| 3,242,607 | A | | 3/1966 | Tappehorn | |
| 3,722,358 | A | | 3/1973 | Seecamp | |
| 3,857,325 | A | * | 12/1974 | Thomas | 42/70.02 |
| 4,031,648 | A | * | 6/1977 | Thomas | 42/70.02 |
| 4,481,863 | A | | 11/1984 | Zanner et al. | |
| 4,589,327 | A | | 5/1986 | Smith | |
| 5,000,075 | A | | 3/1991 | Tuma | |
| 5,086,579 | A | | 2/1992 | Flatley et al. | |
| 5,216,195 | A | | 6/1993 | Tuma | |
| 5,251,394 | A | | 10/1993 | Bornancini | |
| 5,303,494 | A | | 4/1994 | Tuma et al. | |
| 5,388,362 | A | * | 2/1995 | Melcher | 42/70.02 |
| 5,400,537 | A | * | 3/1995 | Meller et al. | 42/69.03 |
| 5,437,120 | A | | 8/1995 | Dornaus | |
| 5,438,784 | A | * | 8/1995 | Lenkarski et al. | 42/70.02 |
| 5,465,518 | A | | 11/1995 | Blaser | |
| 5,570,527 | A | | 11/1996 | Felicci | |
| 5,596,162 | A | * | 1/1997 | Burns | 84/142 |
| 5,625,971 | A | | 5/1997 | Tuma et al. | |
| 6,125,735 | A | * | 10/2000 | Guhring | 42/69.03 |
| 6,240,669 | B1 | * | 6/2001 | Spaniel et al. | 42/70.02 |
| 6,253,479 | B1 | * | 7/2001 | Fuchs et al. | 42/70.02 |
| 6,256,918 | B1 | * | 7/2001 | Szabo | 42/69.03 |

OTHER PUBLICATIONS

U.S. patent application 2002/0020100A1, Roca et al. Feb. 21, 2002.*

* cited by examiner

*Primary Examiner*—Peter M Poon
*Assistant Examiner*—Troy L. Chambers
(74) *Attorney, Agent, or Firm*—Michael A. Mann; Nexsen Pruet Jacobs & Pollard, LLC; William Y. Klett

(57) ABSTRACT

A fire control system with a decocking lever that operates to decock the hammer and also as a safety. The fire control system also has a magazine safety to complement the decocking lever's dual functions. The magazine safety is in the "safety on" position when a magazine is not fully seated in the magazine well and in the "safety off" position when the magazine is fully seated. In one embodiment, rotating the decocking lever by lifting one of the thumb tabs applies the safety if the hammer is cocked and rotating the decocking lever in the other direction causes the sear to release the hammer but catch it before it reaches the firing pin. In an alternate embodiment, the decocking lever can be used as a safety regardless of whether the hammer is cocked or not. Further rotation lower a cocked hammer.

20 Claims, 11 Drawing Sheets

DECOCKING LEVER

FIELD OF THE INVENTION

The present invention relates generally to decocking levers for firearms, that is, levers used to safely lower the hammer of a cocked firearm.

BACKGROUND OF THE INVENTION

Firearm safety is an important issue and one that has long been studied by firearm designers. There are many different aspects of this issue but one in particular deals with how best to lower the hammer of a firearm without discharging the firearm after the hammer has been cocked. In many cases the trigger can be pulled while the user keeps a thumb on the hammer. The user's thumb lowers the hammer gently so that it will not strike the chambered round. Because the user's thumb may slip off the hammer, the possibility for inadvertent discharge remains.

To address this issue, designers of firearms have incorporated "decocking" levers into the designs of some firearms. Pressing a decocking lever causes the hammer to be lowered without discharging the firearm. As with many other aspects of firearm safety, there are a number of different designs for decocking levers.

A good design operates reliably and predictably, makes good use of the limited space in a firearm, and accommodates various users. There remains a need for a better decocking lever for firearms.

SUMMARY OF THE INVENTION

According to its major aspects and briefly recited, the present invention is a decocking lever for a firearm. The present decocking lever not only decocks the hammer to a safe position when pressed down, but also acts as a manual safety. Furthermore, the present design facilitates the inclusion of a magazine safety that disables the firearm when a magazine is not fully inserted and is operable by left handed and right handed users alike. The additional functions of the decocking lever are achieved by the use of a hammer link between the hammer and the trigger bar.

The dual function of the decocking lever, which is to operate as a manual safety and a decocking lever using a single lever, is an important feature of the present invention. Simplified controls for a firearm make it easier to learn to use.

The use of a hammer link to decouple the trigger bar from the hammer is another important feature of the present invention. This feature provides a simple way to place the firearm in a safe state using the magazine safety or the decocking lever or both.

The use of an elongated, but otherwise circular hole in the decocking lever is another feature of the present invention. The hole allows the decocking lever to rotate about the hammer bushing. The fact that the hole is elongated allows the lever to move translationally as well. Having the capability to move both rotationally and translationally allows the decocking lever to operate without additional linkages and thus reduce the number of moving parts.

Other features and their advantages will become apparent to those skilled in the art of firearm design from a careful reading of the Detailed Description of Preferred Embodiments, accompanied by the following drawings.

DETAILED DESCRIPTION OF PREFERRED EMBODIMENTS

The present invention is a safety system for a firearm, and an automatic pistol in particular, having several major components. This system includes a decocking lever that allows the hammer to be released from the cocked position to a safe, intermediate position slowly so as not to strike the firing pin. The system also includes a magazine safety that prevents firing of the firearm when there is no magazine fully seated in the magazine well. Finally, the system also includes a safety that can be applied to prevent firing at other times. There are two embodiments of this third safety disclosed and illustrated herein.

These features will be described fully below in turn. Because of there importance, several important components will be mentioned briefly now. One of these is a hammer link. The purpose of the hammer link is two-fold. Its primary purpose is to transmit rearward motion of the trigger and trigger bar to the hammer in order to cock the hammer. Its secondary purpose is to provide a structure that can be used to decouple movement of the trigger and the hammer so that their movement does not cock the hammer. Thus the hammer link is important in preventing the firearm from being cocked under two circumstances: when no magazine is fully seated and when the safety is in the "safety on" position.

The other important feature is the decocking lever, which is mounted on the hammer bushing in such a way as to have a shifting axis of rotation, so that, when rotated first about one axis and then about another, it causes a number of events to take place in the correct order. In one embodiment, this lever, when rotated clockwise (as seen from the left side of the pistol), applies the safety to a cocked pistol, and when rotated counter clockwise, decocks the hammer. This safety can only be activated when the hammer is cocked. When the hammer is not cocked and the decocking lever is rotated upwards as if to activate the safety, a web across the center of the decocking lever stops on the lower portion of the hammer. In the second, alternative embodiment, this lever can be rotated counter-clockwise both for applying the safety to either a cocked or uncocked pistol and for decocking the hammer.

Figure 1:
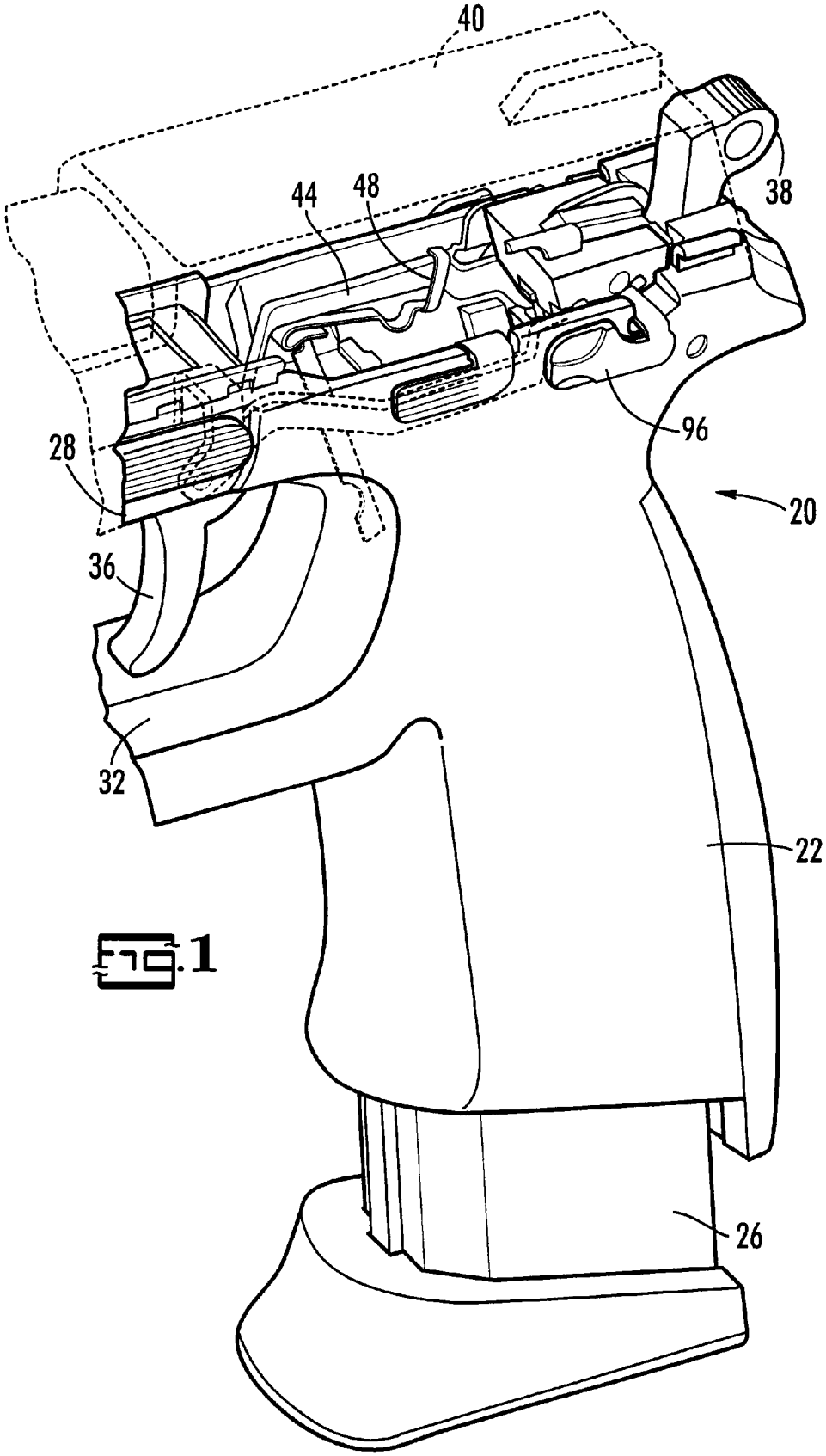
FIG. 1 is a perspective view of a part of an automatic pistol showing the handle, the trigger and a portion of the fire control system according to a preferred embodiment of the present invention.
Figure 2:
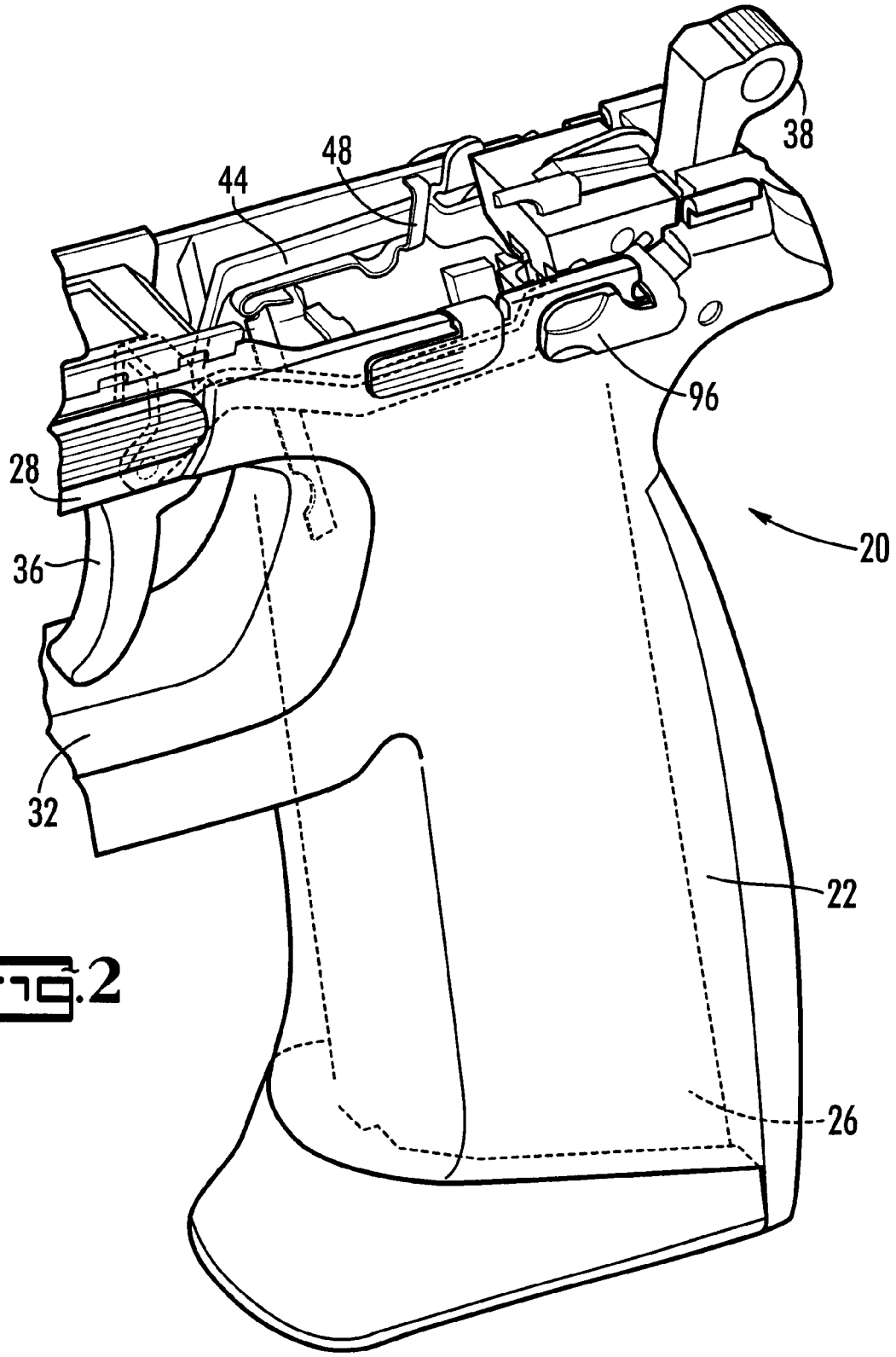
FIG. 2 shows the automatic pistol of FIG. 1 but with the magazine fully seated to unlock the magazine safety.
Figure 3:
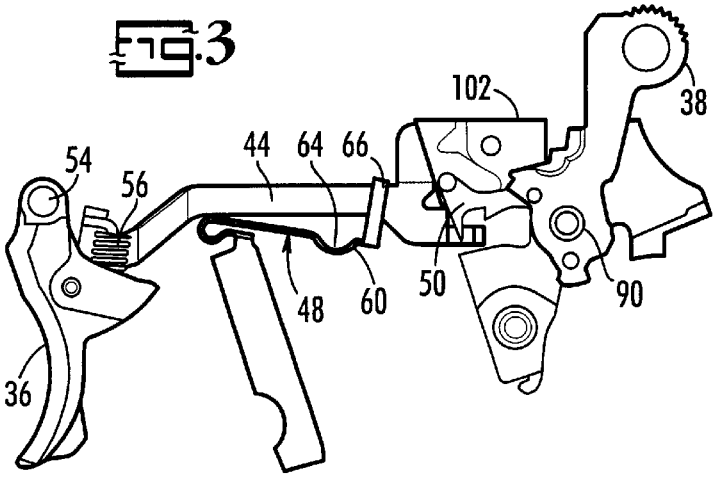
FIG. 3 illustrates a side view of the fire control system with the magazine safety in the "safety on" position, according to a preferred embodiment of the present invention.
Figure 4:
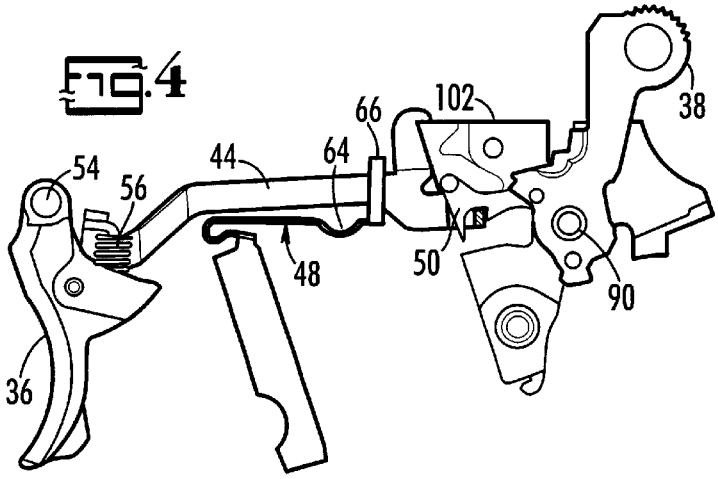
FIG. 4 illustrates a side view of the fire control system with the magazine safety in the "safety off" position.
Figure 5:
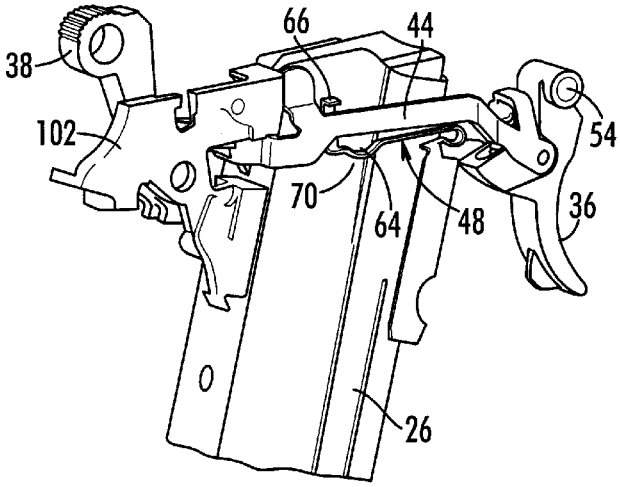
FIG. 5 illustrates in perspective and from a reverse angle of that used in FIG. 4, the magazine safety, according to a preferred embodiment of the present invention.

FIGS. 1 and 2 illustrate in perspective the rear portion of an automatic pistol 20. The two figures are very similar except for two differences. Both show a view of the components of the present safety system, a pistol handle 22 with a magazine 26, part of the frame 30, a portion of the trigger guard 32 and the trigger 36. Both also show a hammer 38 at rest. In FIG. 1, however, the slide 40 of pistol 20 is shown in phantom lines to indicate its position, and magazine 26 is shown being only partially, not fully, inserted. The magazine safety is in the "safety on" position in FIG. 1 and in the "safety off" position in FIG. 2. Note, in particular, that a trigger bar 44 is shown being pulled down slightly by a magazine disconnect spring 48 in FIG. 1 but shown freed from the restraint of magazine disconnect spring 48 in FIG. 2. FIGS. 3, 4 and 5 further illustrate the effect of magazine disconnect spring 48 on trigger bar 44.

FIGS. 3 and 4 are left side views of trigger 36, trigger bar 44, a hammer link 50 and hammer 38 of the present invention. FIG. 5 is a right side perspective view with a portion of magazine 26 shown as if it were fully inserted into a magazine well. FIG. 3 corresponds to FIG. 1, in that magazine 26 (not shown in FIG. 3) is only partially inserted so magazine safety is in the "safety on" position; FIGS. 4 and 5 correspond to FIG. 2, in that magazine 26 (not shown in FIG. 4 but shown in FIG. 5) is fully inserted and seated in a magazine well and, thus, the magazine safety is in the "safety off" position.

Referring now to these figures in detail, trigger 36 is pivotally mounted to frame 40 of pistol 20 so that it can be pulled, whereby it will rotate counter clockwise about its pivot pin 54. A trigger spring 56 biases trigger bar 44 in an upward position. Counteracting that upward pressure on trigger bar 44, when magazine 26 is not fully inserted, is downward pressure from magazine disconnect spring 48. Magazine disconnect spring 48, one end of which is held fast within a recess on the magazine well wall of the handle 22 of pistol 20, has a lever arm 60 with a notch 64 and a hook 66. Hook 66 wraps loosely around trigger bar 44 and pulls it down when no magazine 26 is seated fully in magazine well. When magazine 26 is not fully seated, hook 66 holds trigger bar 44 down regardless of whether trigger 36 is pulled, and trigger spring 56 is further compressed, or not. Trigger bar 44 merely slides through hook 66 when trigger 36 is pulled.

If magazine 26 is seated fully within the magazine well, a projection 70 on the side of magazine 26 catches notch 64 of magazine disconnect spring 48, lifting it and lever arm,70 upward, freeing trigger bar 44 from the downward pressure provided through hook 66 and allowing trigger bar 48 to rise.

Figure 14:
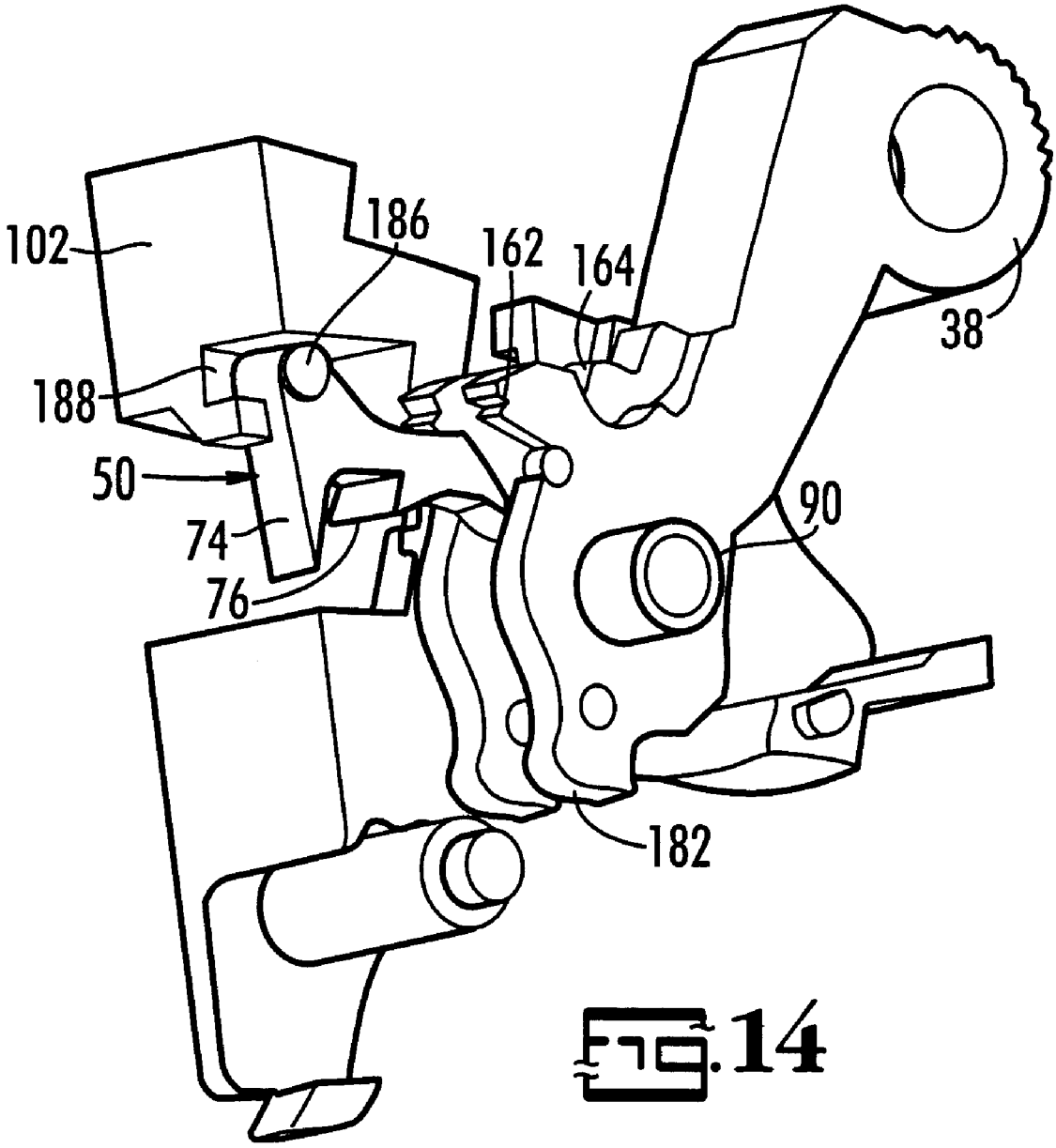
FIG. 14 is a perspective view of a portion of a fire control system showing the hammer link and its relationship to the hammer and fire control housing, according to a preferred embodiment of the present invention.
Figure 15:
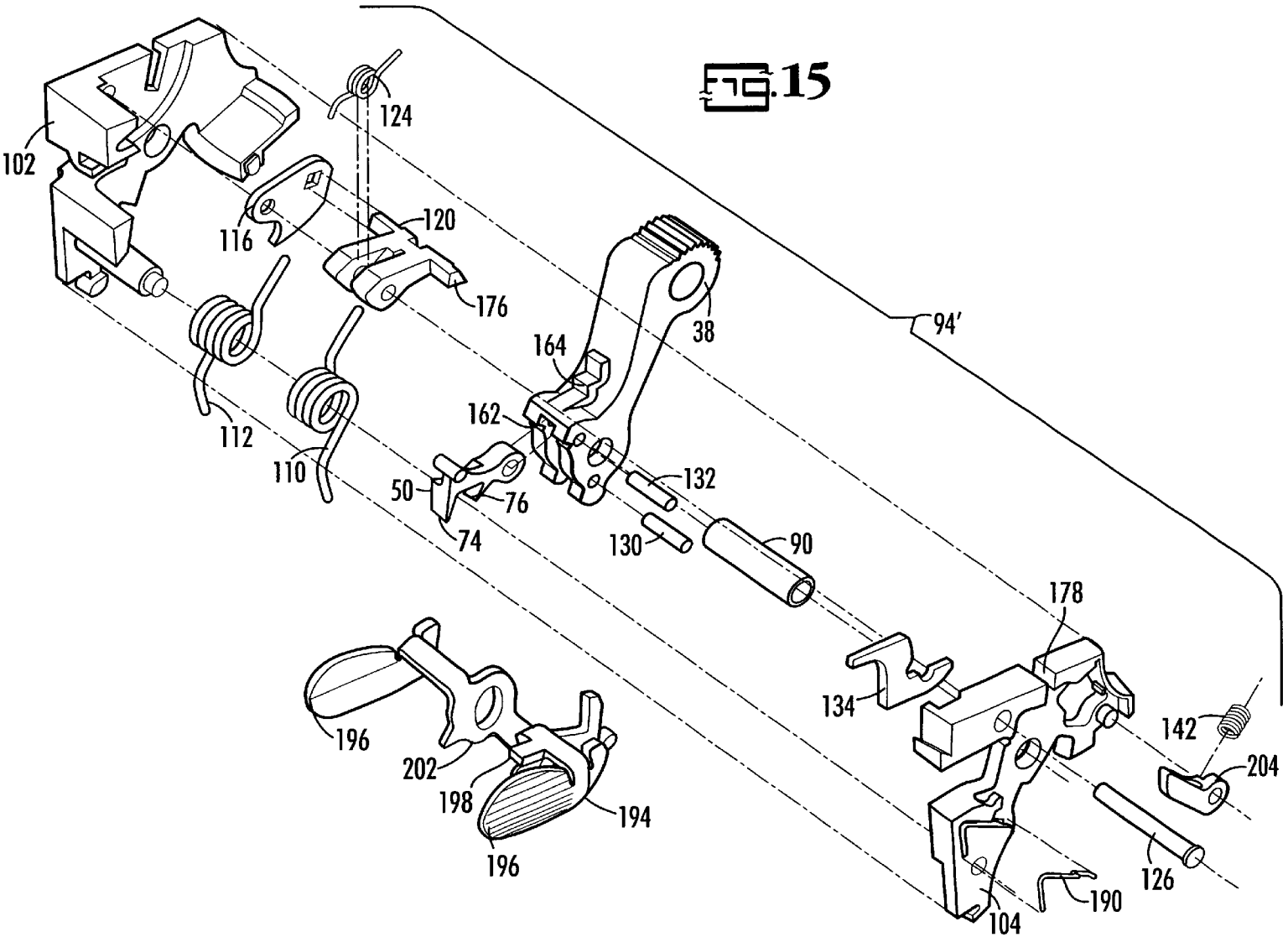
FIG. 15 is an exploded view of a fire control system with a decocking lever according to an alternative preferred embodiment of the present invention.
Figure 16:
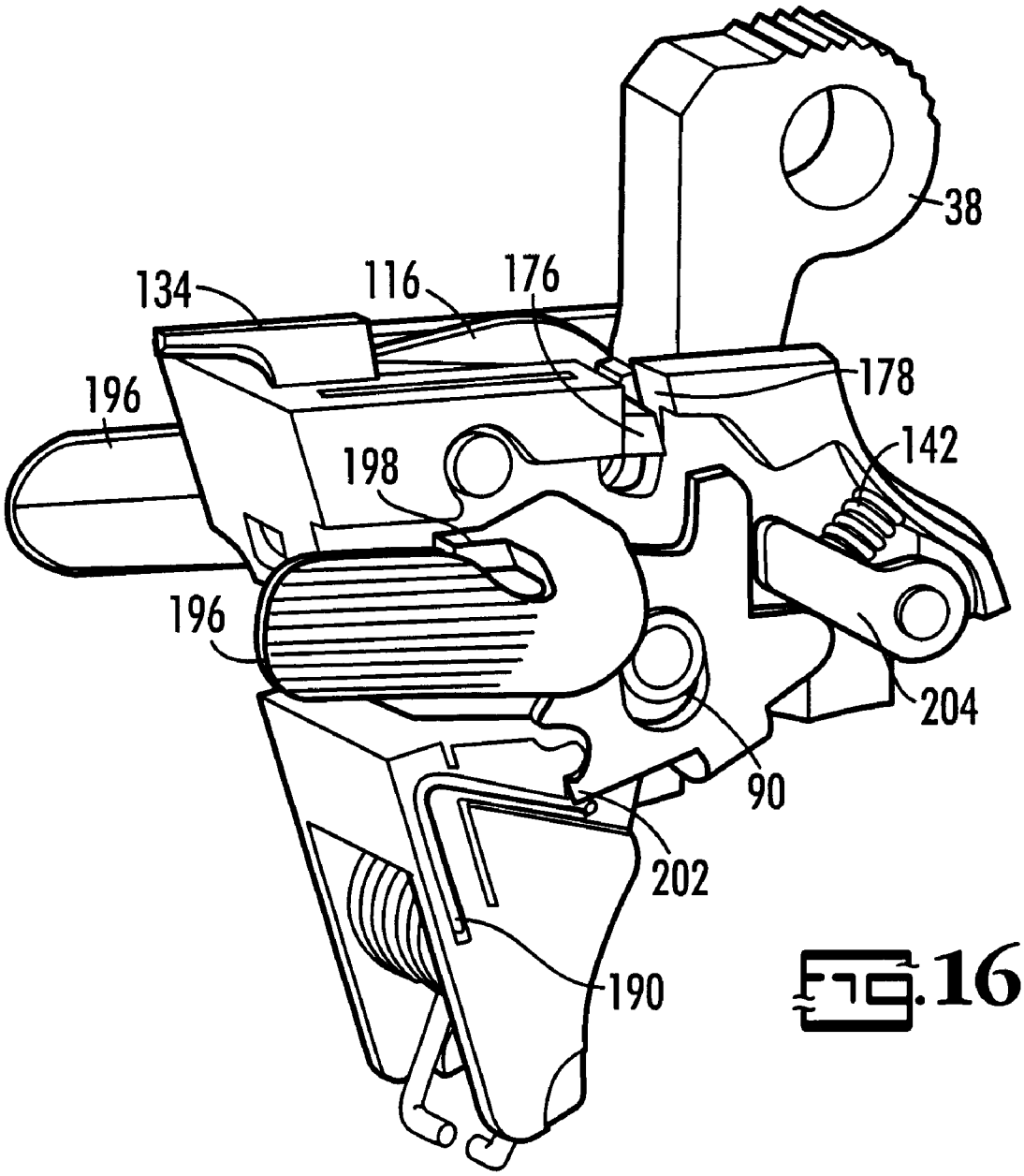
FIGS. 16–18 illustrate in perspective the alternate decocking lever in a sequence of steps wherein it operates as a safety, according to a preferred embodiment of the present invention.
Figure 17:
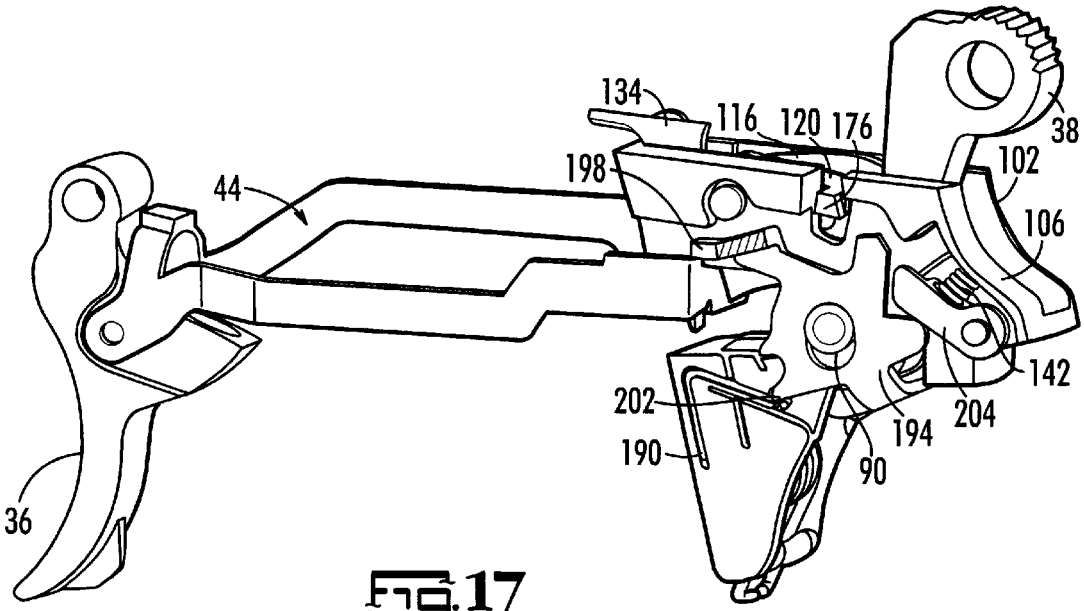
Figure 18:
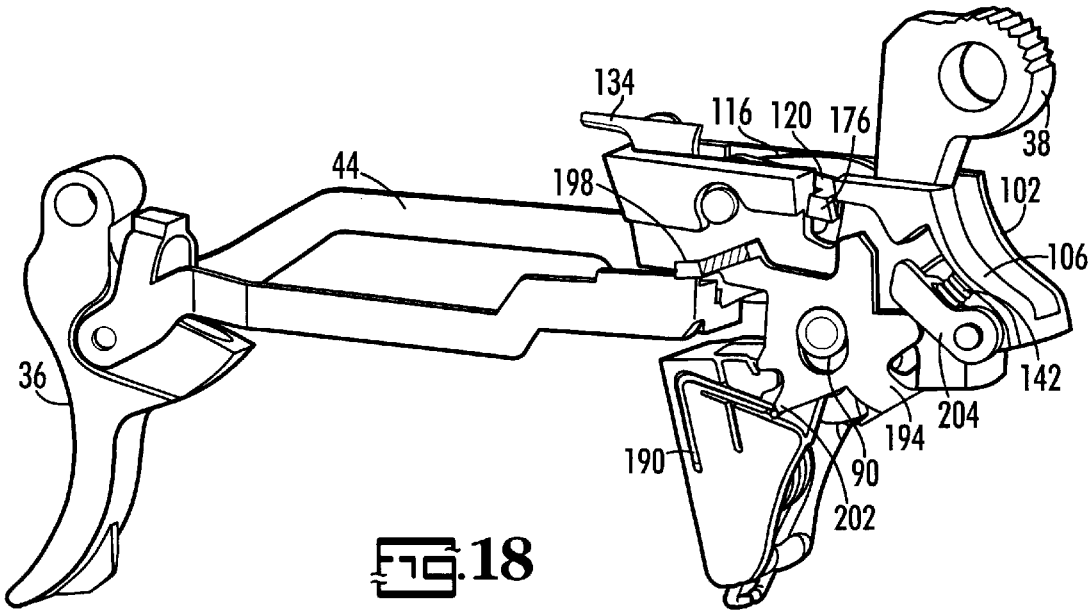

Between hammer 38 and trigger bar 44 is hammer link 50 (see also FIG. 14). Hammer link 50 has two downwardly depending teeth, a forward tooth 74 (toward trigger) and an opposing, spaced-apart, rearward tooth 76, with a gap 80 thus defined between them. Trigger bar 44, which is shaped roughly like the perimeter of a rectangle, crosses gap 80 between forward and rearward teeth 74, 76, before returning forward toward trigger 36 on the other side of pistol 20. Rearward tooth 76 is shorter than forward tooth 74. If trigger bar 44 is pulled downward by hook 66 of magazine safety, it will clear rearward tooth 76. If trigger bar 44 is not being pulled downward, it will catch rearward tooth 76 and push it rearwards. Hammer link 50 cams hammer 38 rearward when a surface 84 on hammer link 50 engages a corresponding surface 86 on hammer and hammer link 50 is being moved rearward. This engagement causes hammer 38 to rotate clockwise about a hammer bushing 90, thus cocking hammer 38.

It will be seen that the full insertion of magazine 26 will cause trigger bar 44 to be lifted against the downward urging of magazine disconnect spring 48 so that, when trigger 36 is pulled, trigger bar 44 can move the rearward tooth 76 of hammer link 50. As hammer link 50 moves rearwardly, surface 84 on hammer link 50 engages surface 86 on hammer 38, rotating hammer 38 clockwise to its cocked position.

Figure 6:
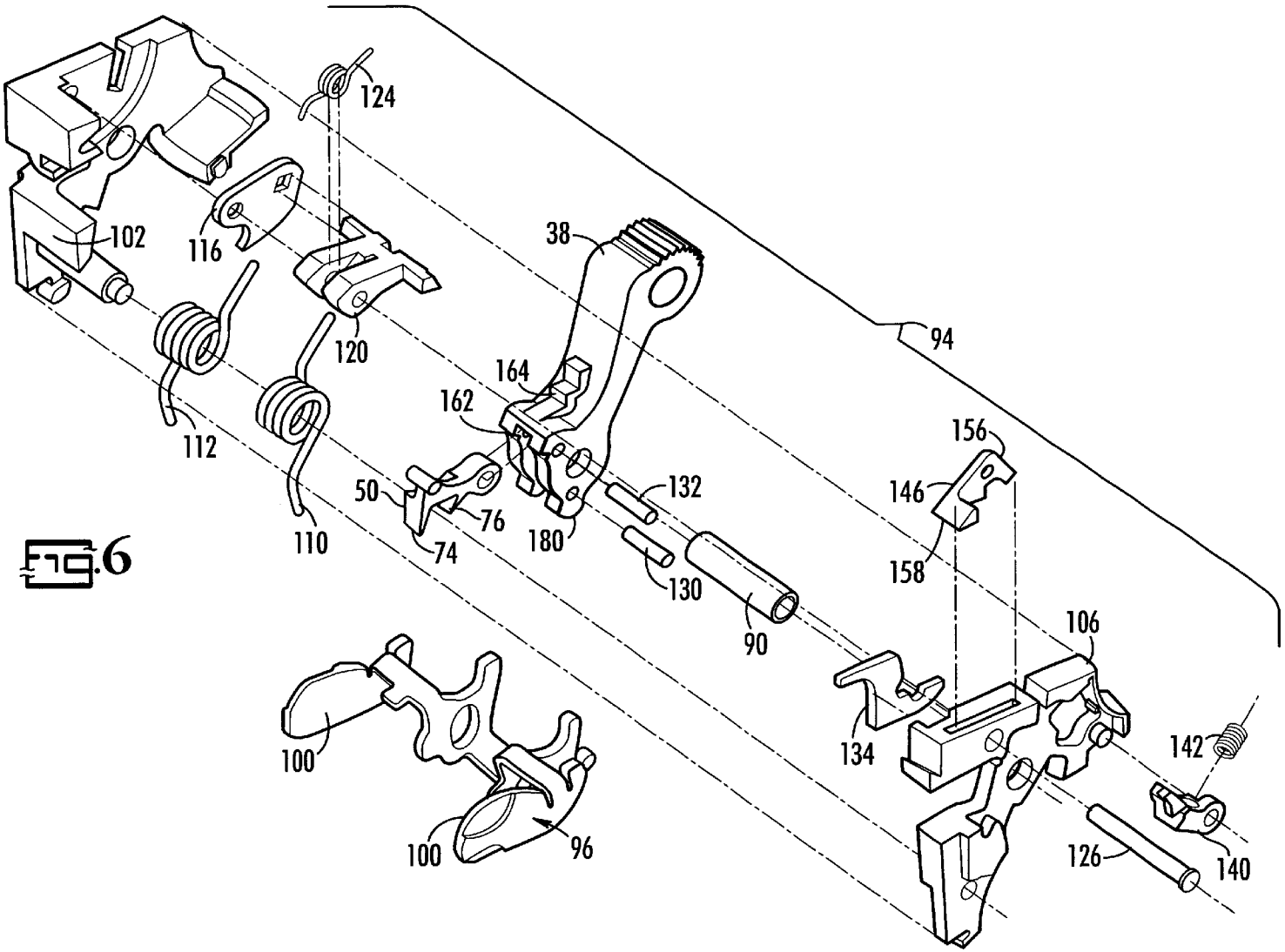
FIG. 6 illustrates an exploded view of the fire control mechanism showing the decocking lever and related components, according to a preferred embodiment of the present invention.
Figure 7:
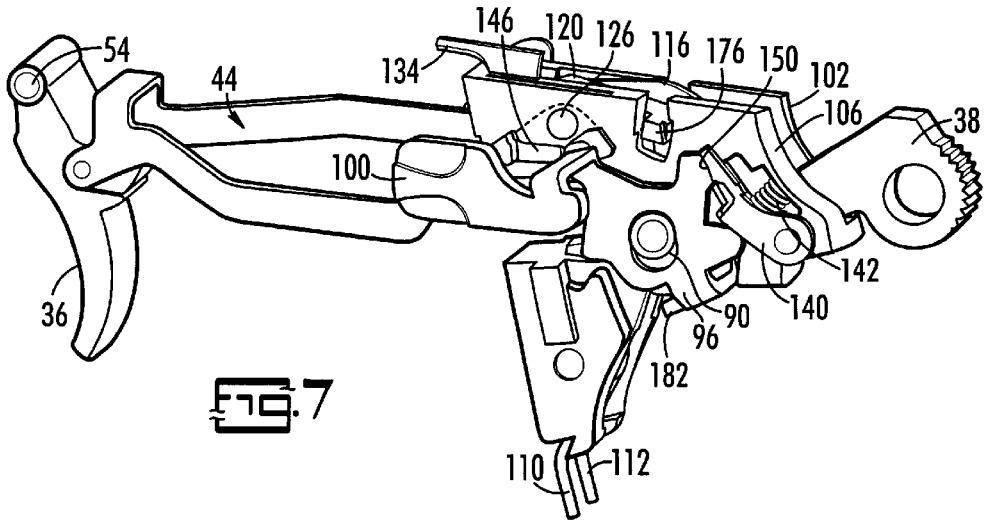
FIGS. 7–9 illustrate in perspective a sequence of steps showing the operation of the present decocking lever as a safety, according to a preferred embodiment of the present invention.
Figure 8:
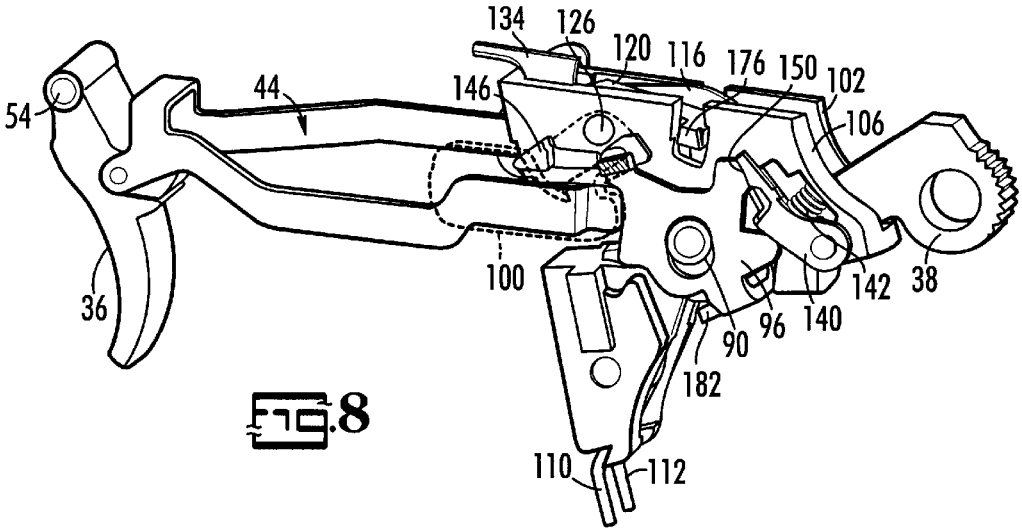
Figure 9:
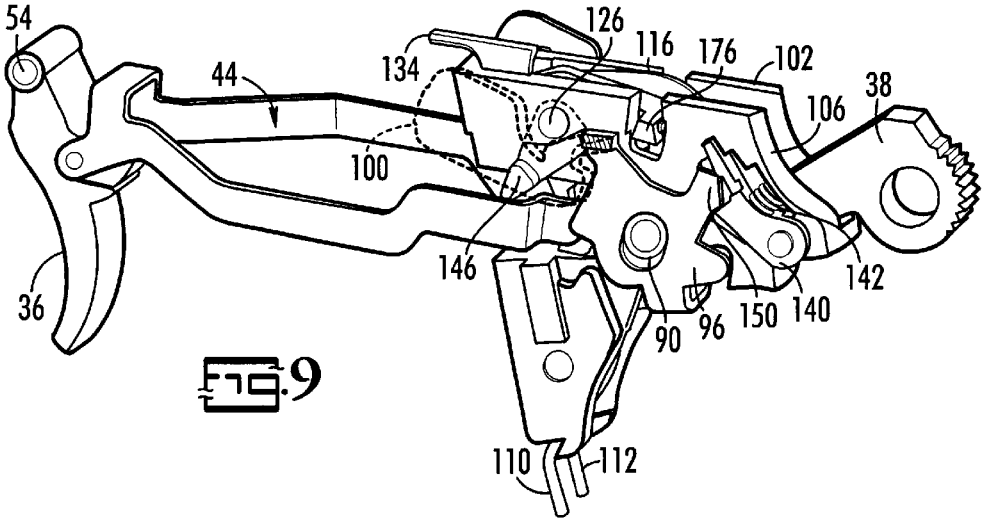
Figure 10:
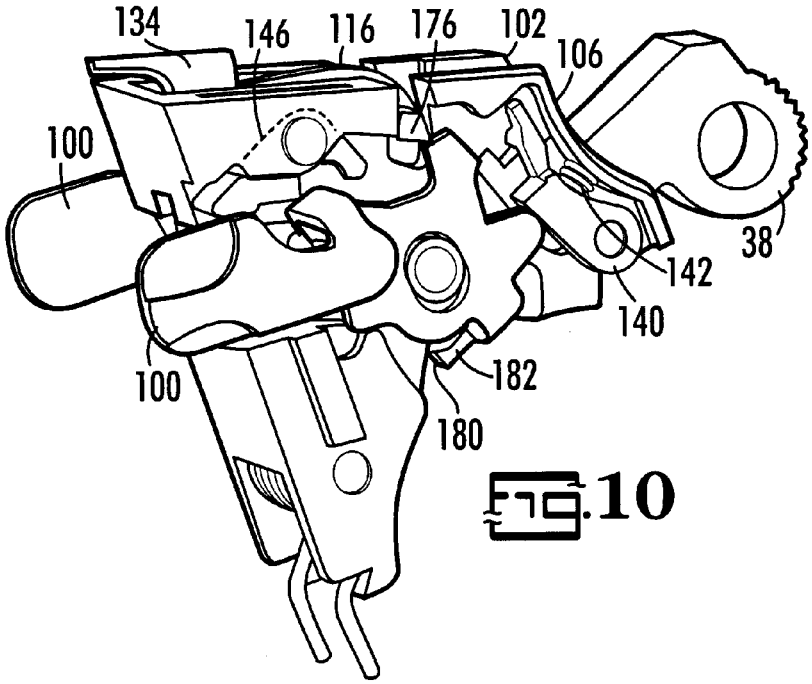
FIGS. 10–13 illustrate in perspective the sequence of steps showing the operation of the present decocking lever in decocking the hammer, according to a preferred embodiment of the present invention.

FIG. 6 illustrates an exploded view of decocking lever 96, as well as hammer 38, hammer link 50, and related components. FIGS. 7, 8, and 9 illustrate the operation of the safety resulting from the clockwise rotation of the decocking lever 96 after hammer 38 is cocked. In particular, FIGS. 7 and 8 are both perspective views of trigger 36, trigger bar 44, decocking lever 96 and hammer 38 but with part of decocking lever 96 shown in phantom lines in FIG. 8. In both figures, decocking lever 96 is shown in the "safety off" position (and trigger bar 44 is shown in the "safety off" position as well). In FIG. 9, decocking lever 96, partially in phantom lines, is shown rotated to the "safety on" position.

The exploded view illustrated in FIG. 6 is useful in describing decocking lever 96 as a safety and in its primary function, namely, decocking hammer 38. This figure shows the fire control housing 102 and opposing cover plate 106. Between them is hammer 38, a hammer bushing 90, two hammer springs 110, 112, a sear actuator 116, a sear 120, a sear spring 124, a sear pin 126, hammer link 50, two hammer link pins 130,132, and an ejector 134. Outside cover plate 106 is decocking lever 96, a rebound lever 140 and rebound lever spring 142 and a trigger bar disconnect lever 146. It is this last component, trigger bar disconnect lever 146, working in combination with rebound lever 140, rebound spring 142, decocking lever 96 and trigger bar disconnect lever 48, that acts as a safety in that it prevents the pulling of trigger 36 from causing the firing of pistol 20.

Referring in particular now to FIGS. 7, 8, and 9, hammer 38 must be cocked, as shown in all three figures, for this embodiment to operate. In FIGS. 7 and 8, rebound lever 140 is in the rest position pressing against decocking lever 96 at A and B to hold thumb tab 100 in an at-rest position. When thumb tab 100 is raised, decocking lever 96 is rotated clockwise. A surface 150 on the rotating decocking lever 96 lifts rebound lever 140 against the urging of rebound lever spring 142, and slides it past A and into a detent 152 in rebound lever 140. There, decocking lever 96 is held in the "safety on" position. Decocking lever 96, as it rotates clockwise, also lifts a first end 156 (best seen in FIG. 6) of trigger bar disconnect lever 146, rotating it counter clockwise about sear pin 126, loading sear spring 124. The rotation of this first end 156 about sear pin 126 causes an opposing, second end 158 (best seen in FIG. 6) of trigger bar disconnect lever 146 to press down on trigger bar 44, in a manner similar to that of hook 66 on magazine disconnect spring 48 when magazine 26 is removed from its magazine well.

Once trigger bar 44 has been depressed by trigger bar disconnect lever 48, the pull of trigger 36 will not translate from trigger bar 44 through hammer link 50 to hammer 38. As trigger 36 is pulled, trigger bar 44 will simply slide rearwards below rearward tooth 76 of hammer link 50 and not transfer the motion of the trigger 36 through it to hammer 38.

Rotation of decocking lever 96 counter clockwise to the at-rest position removes surface 150 from detent 152 of rebound lever 140, returning it to engagement with surface A.

Further counter clockwise rotation of decocking lever 96 decocks a cocked hammer 38, as illustrated in FIGS. 10, 11, 12, 13, and 14. Briefly summarizing the events that take place when decocking hammer 38, rotation of decocking lever 96 in a counter clockwise direction lifts sear 120 out of a first catch 162 (see FIG. 14) on hammer 38, to cause hammer 38 to fall. The falling hammer 38 pushes decocking lever 96 down, and with it, sear 120 also falls in time to stop hammer 38 at a second catch 164 just short of the firing pin. The specific events that take place as a result of the decocking of hammer 38 will now be described in detail.

After rotating decocking lever 96 counter clockwise about hammer bushing 90 through a small arc, a projection 168 on decocking lever rotates into contact with cover plate 106 at C. Further rotation about bushing 90 is thus halted but, because the hole 172 through decocking lever 96 for bushing 90 is elongated and somewhat oval, the hole not only allows rotation, but translation of decocking lever 96 as well. Thus, the axis of rotation will shift at this point from the center of hammer bushing 90 to point C, and the counter clockwise rotation of decocking lever 96, as best seen by comparison of FIGS. 10 and 11, continues but results in a lifting of decocking lever 96.

The lifting of decocking lever 96 in turn lifts sear 120. Sear 120 has a sear arm 176 that extends through notch 178 in cover plate 106 to the point where it will come into contact with the rising decocking lever 96. Decocking lever 96, as it is lifted, pushes sear arm 176 up. The lifting of sear arm 176 causes sear actuator 120 to clear first catch 162 in hammer 38. Hammer 38, under the force of hammer springs 110, 112, which were loaded when hammer 38 was cocked, falls forward, rotating counter clockwise around hammer bushing 90.

Figure 11:
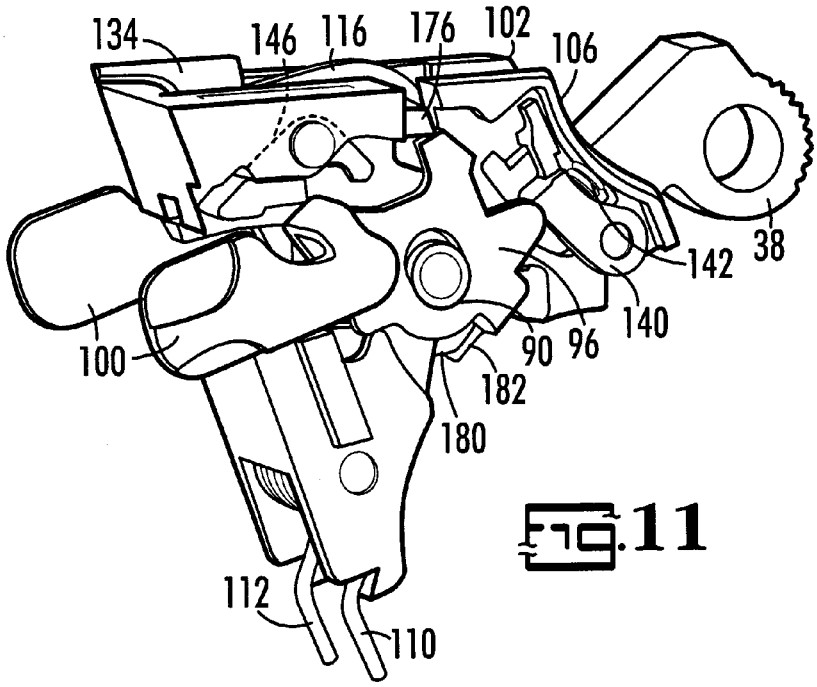
Figure 12:
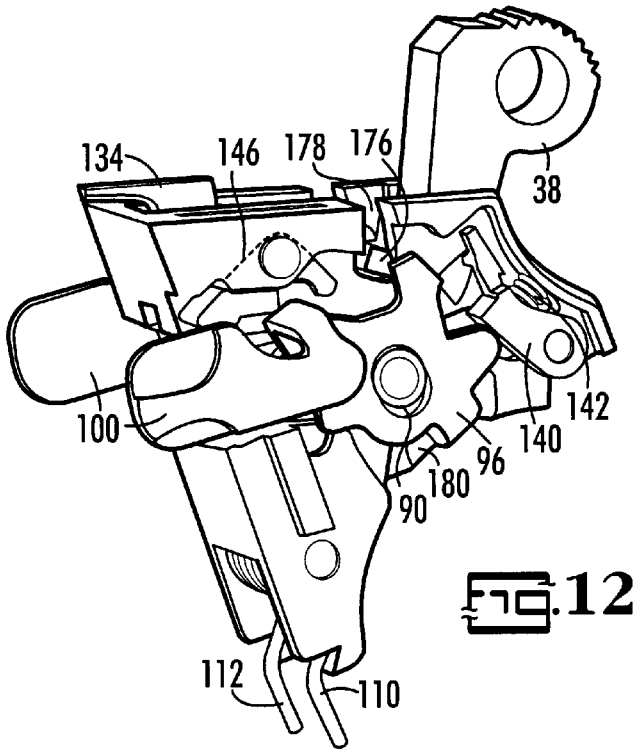
Figure 13:
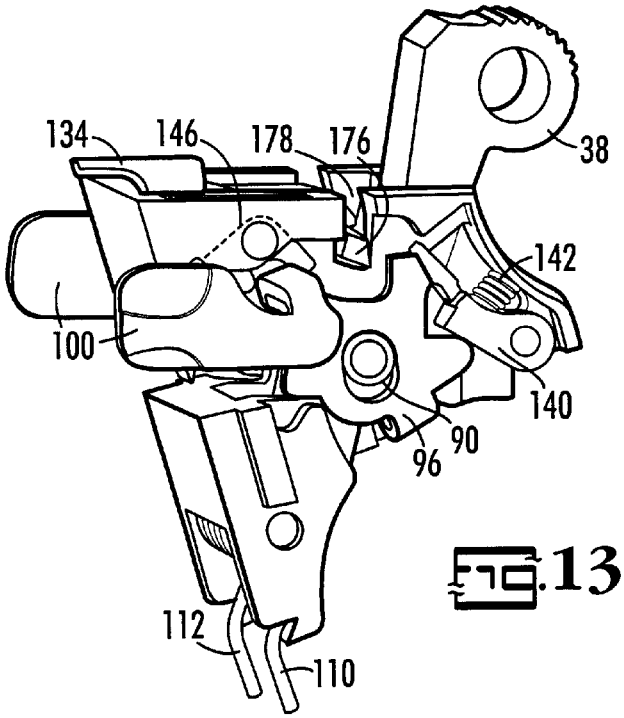

As illustrated in FIGS. 11 and 12, the rotation of hammer 38 causes its lower surface 180 (better seen in FIGS. 6 and 14) to cam decocking lever 96 downward at tab 182 (better seen in FIGS. 7 and 8), rotating it about C now in a clockwise direction. As decocking lever 96 is lowered, sear arm 176 and thus sear 120, urged by sear spring 124, are allowed to slip into second catch 164 on hammer 38 just before hammer 38 meets the firing pin. Rebound lever 140, urged by rebound lever spring 142, pressing on decocking lever 96, further restores it to its initial at-rest position.

Decocking lever 50 has two projections 186 that ride in channels 188 defined by recesses formed in fire control housing 102 and cover plate 106 (in FIG. 14 one projection 186 and one channel 188 are visible). Channels 188 are parallel to each other to hold lever 50 in position but permit its translational movement. Projections 186, slightly rounded on their ends to reduce friction, allow smooth, accurate movement of lever 50 as trigger bar 44 causes it to move laterally forward and backward between trigger 36 and hammer 38.

In an alternate embodiment, illustrated in FIGS. 15–18, the decocking lever both decocks hammer 38 and acts as a safety; however, its function as a safety operates somewhat differently. For convenience, the same reference numbers are used in these figures for the components that are unchanged in this alternative embodiment. Components that are changed have different reference numbers than their equivalent component in the previously described embodiment.

In particular, trigger bar disconnect lever 146 is eliminated and a manual safety detent spring 190 has been added. Manual safety detent spring 190 acts to hold down trigger bar 44, much as trigger bar disconnect lever 146 did in the previous embodiment, but does so regardless of whether hammer 38 is cocked.

To operate a decocking lever 194 in this embodiment as a safety, the user presses down on one of the two thumb tabs 196 of decocking lever 194, rotating it in the counter clockwise direction. A first projection 198 on decocking lever 194 makes contact with trigger bar 44 and forces it down against the urging of trigger spring 56. Simultaneously, manual safety detent spring 190 is forced to flex downward by a second projection 202 on decocking lever 194. Once flexed far enough, manual safety detent spring 190 snaps in front of second projection 202 to hold decocking lever 194 until the safety is moved to the "safety off" position. Meanwhile, trigger bar 44 has been forced downward far enough so that, when it is moved rearward by actuation of trigger 36, trigger bar 44 will slide under rearward tooth 76 of hammer link 50. To move the safety to the "safety off" position, the user pushes up on thumb tab 196. A modified rebound lever 204 is used with this embodiment.

Those skilled in the art of fire control safety systems will appreciate that many substitutions and modifications can be made to the foregoing preferred embodiment without departing from the spirit and scope of the present invention, defined by the appended claims.

It will be apparent to those skilled in the art of firearm safety that many changes and substitutions can be made to the foregoing preferred embodiment without departing from the spirit and scope of the present invention, which is defined by the amended claims.

What is claimed is:

1. A fire control system for a firearm, comprising:

a sear;

a trigger;

a trigger bar in operative connection with said trigger so that when said trigger is pulled, said trigger bar moves;

a hammer in operative connection with said trigger bar so that, when said trigger is pulled, said hammer is cocked, said hammer having a cocked position and an uncocked position, said hammer being held in said cocked position by said sear; and decocking means for moving said hammer from said cocked position to said decocked position and for operatively disconnecting said trigger bar from said hammer so that said hammer is not responsive to movement of said trigger bar, said decocking means being adapted to raise said sear to cause said hammer to fall, whereupon said hammer, by falling, forces said decocking means to lower said sear before said hammer reaches said decocked position so that said sear catches said hammer.

2. The fire control system as recited in claim 1, further comprising a hammer link in operative connection with said hammer and said trigger bar so that said hammer link cocks said hammer when said trigger bar moves in response to pulling said trigger.

3. The fire control system as recited in claim 2, wherein said decocking means carries means adapted for disconnecting movement of said trigger arm from movement of said hammer link so that pulling said trigger does not cock said hammer.

4. The fire control system as recited in claim 2, wherein said decocking means, when rotated, disconnects said hammer link and said trigger bar.

5. The fire control system as recited in claim 4, wherein said decocking means disconnects said hammer link and said trigger bar when said hammer is cocked.

6. A fire control system for a firearm, comprising:

a sear;

a trigger;

a trigger bar in operative connection with said trigger so that when said trigger is pulled, said trigger bar moves;

a hammer in operative connection with said trigger bar so that, when said trigger is pulled, said hammer is cocked, said hammer having a cocked position and an uncocked position, said hammer being held in said cocked position by said sear;

first safety means in operative connection with said trigger bar for disconnecting said trigger bar from said hammer so that said trigger bar cannot move said hammer to said cocked position; and decocking means for moving said hammer from said cocked position to said decocked position, said decocking means being adapted to raise said sear to cause said hammer to fall, whereupon said hammer, by falling, causes said decocking means to lower said sear before said hammer reaches said decocked position so that said sear catches said hammer.

7. The fire control system as recited in claim 6, wherein said firearm has a magazine well, and wherein said first safety means is carried by said magazine well.

8. The fire control system as recited in claim 6, wherein said first safety means deflects said trigger bar to disconnect it from operative connection with said hammer.

9. The fire control system as recited in claim 6, wherein said firearm has means for receiving a magazine, and wherein said first safety means disconnects said trigger bar when a magazine is not seated in said receiving means and does not disconnect said trigger bar when said magazine is seated in said receiving means.

10. The fire control system as recited in claim 6, further comprising a second safety means adapted for disconnecting movement of said trigger bar from movement of said hammer so that pulling said trigger does not cock said hammer.

11. The fire control system as recited in claim 6, further comprising a hammer link in operative connection with said hammer and said trigger bar so that said hammer link cocks said hammer when said trigger bar moves in response to pulling said trigger.

12. The fire control system as recited in claim 11, wherein said first safety means deflects said trigger bar from operative connection with said hammer link.

13. A fire control system for a firearm, comprising:

a housing;

a bushing carried by said housing;

a trigger;

a hammer rotatably mounted on said bushing and in operative connection with said trigger so that, when said trigger is pulled, said hammer rotates to a cocked position from an uncocked position;

means carried by said frame for urging said hammer to said uncocked position from said cocked position;

sear means in spaced relation with said hammer and carried by said frame for holding said hammer in said cocked position and in a catch position between said cocked and said uncocked positions, said hammer being held in said cocked position by said sear means; and decocking means for moving said hammer from said cocked position to said decocked position, said decocking means translatably mounted to said bushing so that said decocking means can control said sear means, said decocking means being adapted to raise said sear means to cause said hammer to fall, whereupon said hammer, by falling, causes said decocking means to lower said sear means before said hammer reaches said catch position so that said sear means catches said hammer.

14. The fire control system as recited in claim 13, wherein said decocking means has an elongated hole formed therein dimensioned to receive said bushing and to allow translational movement of said decocking means.

15. The fire control system as recited in claim 13, wherein said hammer is formed to translate said decocking means as said hammer falls from said cocked position.

16. The fire control system as recited in claim 13, wherein said decocking means raises said sear means to cause said hammer to fall and lowers said sear means to catch said hammer as said hammer falls.

17. The fire control system as recited in claim 16, wherein said hammer is formed to translate said decocking means down so as to lower said sear means as said hammer falls, said sear means catching said hammer as said hammer falls.

18. The fire control system as recited in claim 13, further comprising a trigger bar positioned in operating connection between said trigger and said hammer so that, when said trigger is pulled, said trigger bar moves said hammer to said cocked position, and wherein said decocking means further comprises a tab, said tab deflecting said trigger bar out of operating connection with said hammer so that, when said trigger is pulled, said hammer does not move to said cocked position.

19. The fire control system as recited in claim 13, further comprising:

a trigger bar positioned in operating connection between said trigger and said hammer so that, when said trigger is pulled, said trigger bar moves said hammer to said cocked position; and disconnect means rotatably carried by said frame and being rotatable by said decocking means for deflecting said trigger bar out of operating connection with said hammer so that, when said trigger is pulled, said hammer does not move to said cocked position.

20. The fire control system as recited in claim 13, further comprising a hammer link positioned between said trigger and said hammer and in operating connection with said hammer and said trigger so that, when said trigger is pulled, said hammer link moves said trigger to said cocked position.

* * * * *

UNITED STATES PATENT AND TRADEMARK OFFICE

CERTIFICATE OF CORRECTION

PATENT NO. : 6,588,136 B2
APPLICATION NO. : 09/975526
DATED : July 8, 2003
INVENTOR(S) : Richard Baker It is certified that error appears in the above-identified patent and that said Letters Patent is hereby corrected as shown below:

Title Pg. Item (73) Assignee: Should Read,
Assignee: FN Manufacturing, LLC, Columbia, SC Signed and Sealed this Eighth Day of July, 2008

JON W. DUDAS
*Director of the United States Patent and Trademark Office*